US005329434A

United States Patent [19]

Hong

[11] Patent Number: 5,329,434

[45] Date of Patent: Jul. 12, 1994

[54] MODULAR ANGULAR/CURVATURE LIGHT FIXTURE ASSEMBLY

[76] Inventor: Richard Hong, 11576 49'ER Cir., Gold River, Calif. 95670

[21] Appl. No.: 88,862

[22] Filed: Jul. 7, 1993

[51] Int. Cl.[5] ..... F21V 1/00

[52] U.S. Cl. ..... 362/238; 362/249; 362/252

[58] Field of Search ..... 362/238, 239, 249, 252, 362/806

[56] References Cited

U.S. PATENT DOCUMENTS

| | | | |
|---|---|---|---|
| 4,413,311 | 11/1983 | Orenstein | 362/252 X |
| 4,995,181 | 2/1991 | Wolf | 362/252 X |
| 5,057,981 | 10/1991 | Bowen et al. | 362/806 X |

*Primary Examiner*—Stephen F. Husar
*Attorney, Agent, or Firm*—Baker & Daniels

[57] ABSTRACT

A modular angular/curvature light fixture assembly includes a plurality of tubular fixture sections each of which has an opening formed through the wall thereof, a plurality of coupling units interconnecting the tubular fixture sections in such a manner that any adjacent pair of the tubular fixture sections are coupled together by one of the coupling units, an electrical cord unit extending through the tubular fixture sections and connected to an electric power supply, and a plurality of illumination units mounted removably on some of the tubular fixture sections and electrically connected to the electrical cord unit in such a manner that the electrical cord unit extends through the corresponding openings.

5 Claims, 5 Drawing Sheets

MODULAR ANGULAR/CURVATURE LIGHT FIXTURE ASSEMBLY

BACKGROUND OF THE INVENTION

Field of the Invention

This invention relates to a light, more particularly to a modular angular/curvature light fixture assembly the total length of which can be increased according to the needs of the consumers.

Description of the Related Art

Referring to FIGS. 1A, 1B and 1C, a light assembly normally includes a unitary tubular fixture unit 10, 10', 10'' for extension of an electrical cord unit therethrough, and two illumination units 11, 11', 11'' hanging on the fixture unit 10, 10', 10''. If it is desired that the length of the unitary tubular fixture unit is increased, an expensive mold is needed to make the same. Moreover, if the increased length unitary tubular fixture unit is curved, it is difficult to polish and electroplate the same. The electroplating apparatus is too small to electroplate the unitary tubular fixture unit of more than 4 feet in this art. It is understood that only one color can be electroplated on the unitary tubular fixture unit. In a case where the length of the unitary fixture unit is increased to the extent that the working part of an elongated common tool cannot be inserted into the middle portion of the unitary fixture unit, it is difficult to mount the illumination units and the electrical cord units on the middle portion thereof. As a result, the outer appearance of the light assembly is limited in the color and total length of the tubular fixture unit, as well as the number of the illumination units. Because people have become more and more fastidious about the outer appearance of furniture, the above-mentioned conventional light assemblies cannot satisfy the tastes of the consumers.

SUMMARY OF THE INVENTION

An object of this invention is to provide a modular angular/curvature light fixture assembly the total length of which can be increased according to the needs of the consumers.

Another object of this invention is to provide a modular angular/curvature light fixture assembly in which the number of the illumination units can be increased.

According to this invention, a modular angular/curvature light fixture assembly includes a plurality of tubular fixture sections each of which has an opening formed through the wall thereof, a plurality of coupling units interconnecting the tubular fixture sections in such a manner that any adjacent pair of the tubular fixture sections are coupled together by one of the coupling units, an electrical cord unit extending through the tubular fixture sections and connected to an electric power supply, and a plurality of illumination units mounted removably on some of the tubular fixture sections and electrically connected to the electrical cord unit in such a manner that the electrical cord unit extends through the corresponding openings. Because the tubular fixture sections can be joined together one by one, the total length of the light assembly can be increased according to the needs of the consumers. Furthermore, because each of the tubular fixture sections is sufficiently short in length to conveniently mount the illumination units and the electrical cord unit on the tubular fixture sections, when the number of the tubular fixture sections is increased, additional illumination units can be easily mounted on the added tubular fixture sections.

BRIEF DESCRIPTION OF THE DRAWING

Other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 6:
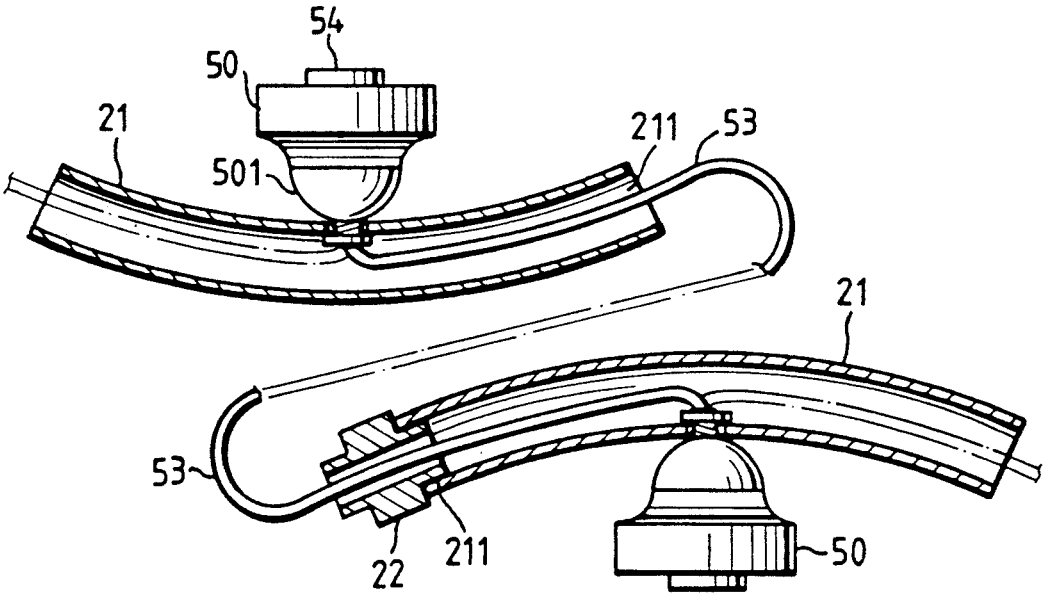
FIG. 6 illustrates how an electrical cord unit is arranged in the light assembly in accordance with the first embodiment of this invention.

Referring to FIGS. 2, 3, 4, 5 and 6, a modular angular/curvature light fixture assembly 20 of this invention includes three curved tubular fixture sections 21, two coupling units 22 each of which interconnects an adjacent pair of fixture sections 21, an electrical cord unit 53 (see FIG. 6) extending through all of the fixture sections 21 and the coupling units 22 and connected to a power supply (not shown), and three illumination units 50 (only two are shown in FIG. 6) respectively mounted on the sections 21.

In this embodiment, each of the coupling units 22 is an elongated metal connector which consists of a large-diameter middle portion 221 and two small-diameter end portions 222 integrally formed with two ends of the large-diameter middle portion 221. Each of the small-diameter end portions 222 is press fitted in an end portion 211 of the tubular fixture sections 21 by means of a machine (not shown).

Each of the fixture sections 21 has an opening 212 formed through the wall thereof. Each of the illumination units 50 includes a light-generating piece 54, a bowl-like shield 501 with a central hole 502 formed through the central portion thereof, a tubular bolt unit 52 having an externally threaded stem 521 extending through the central hole 502 of the shield 501 and one of the openings 212, and a hexagonal nut 51 engaged threadably with the stem 521 of the bolt unit 52 and positioned in one of the tubular fixture sections 21 so as to retain the illumination unit 50 on the tubular fixture section 22. The bolt unit 52 further includes an internally threaded head 522 engaged with the upper end of the stem 521.

Figure 1A:
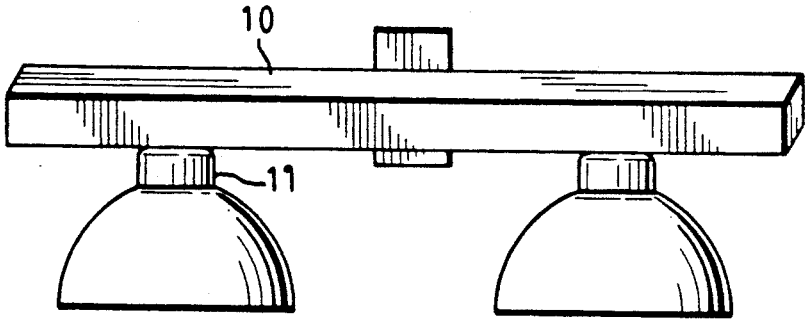
FIG. 1A PRIOR ART
FIGS. 1A, 1B and 1C illustrate three types of conventional light assemblies.
Figure 1B:
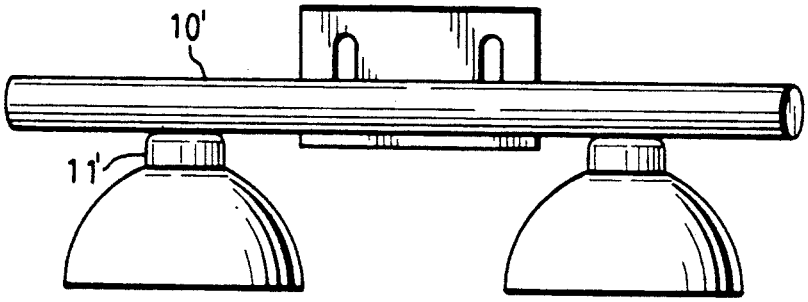
FIG. 1B PRIOR ART
Figure 1C:
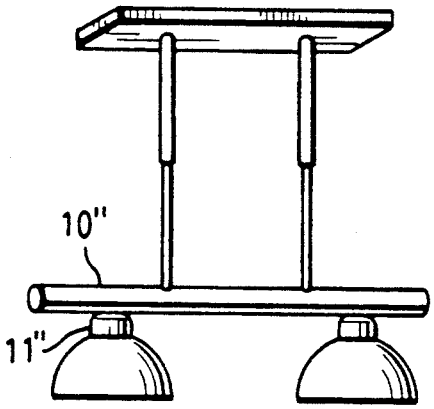
FIG. 1C PRIOR ART
Figure 2:
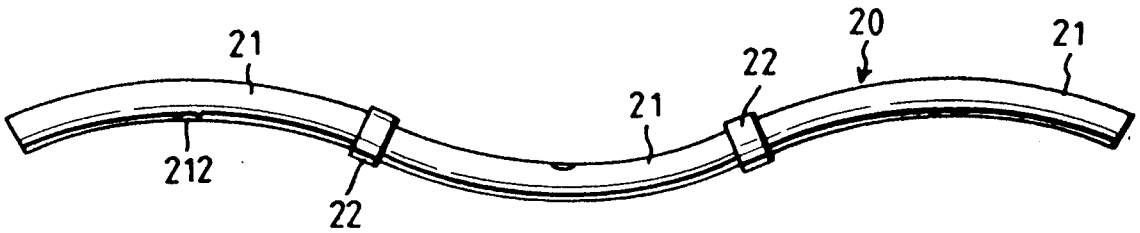
FIG. 2 illustrates a modular angular/curvature light fixture assembly according to a first embodiment of this invention.
Figure 3:
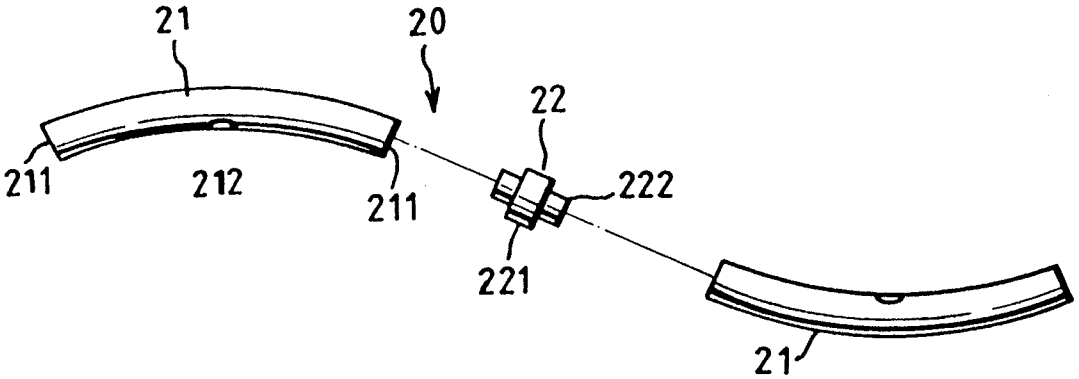
FIG. 3 is an exploded view showing a portion of the modular angular/curvature light fixture assembly according to the first embodiment of this invention.
Figure 4:
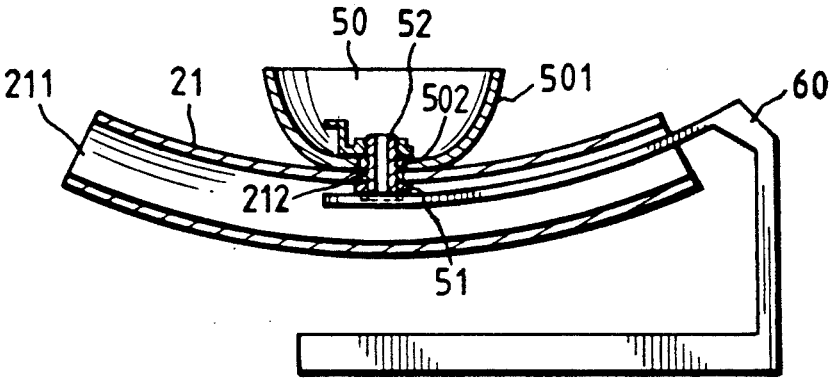
FIGS. 4 and 5 illustrate how an illumination unit is mounted on a tubular fixture section of the modular angular/curvature light fixture assembly by use of a conventional tool in accordance with the first embodiment of this invention.
Figure 5:
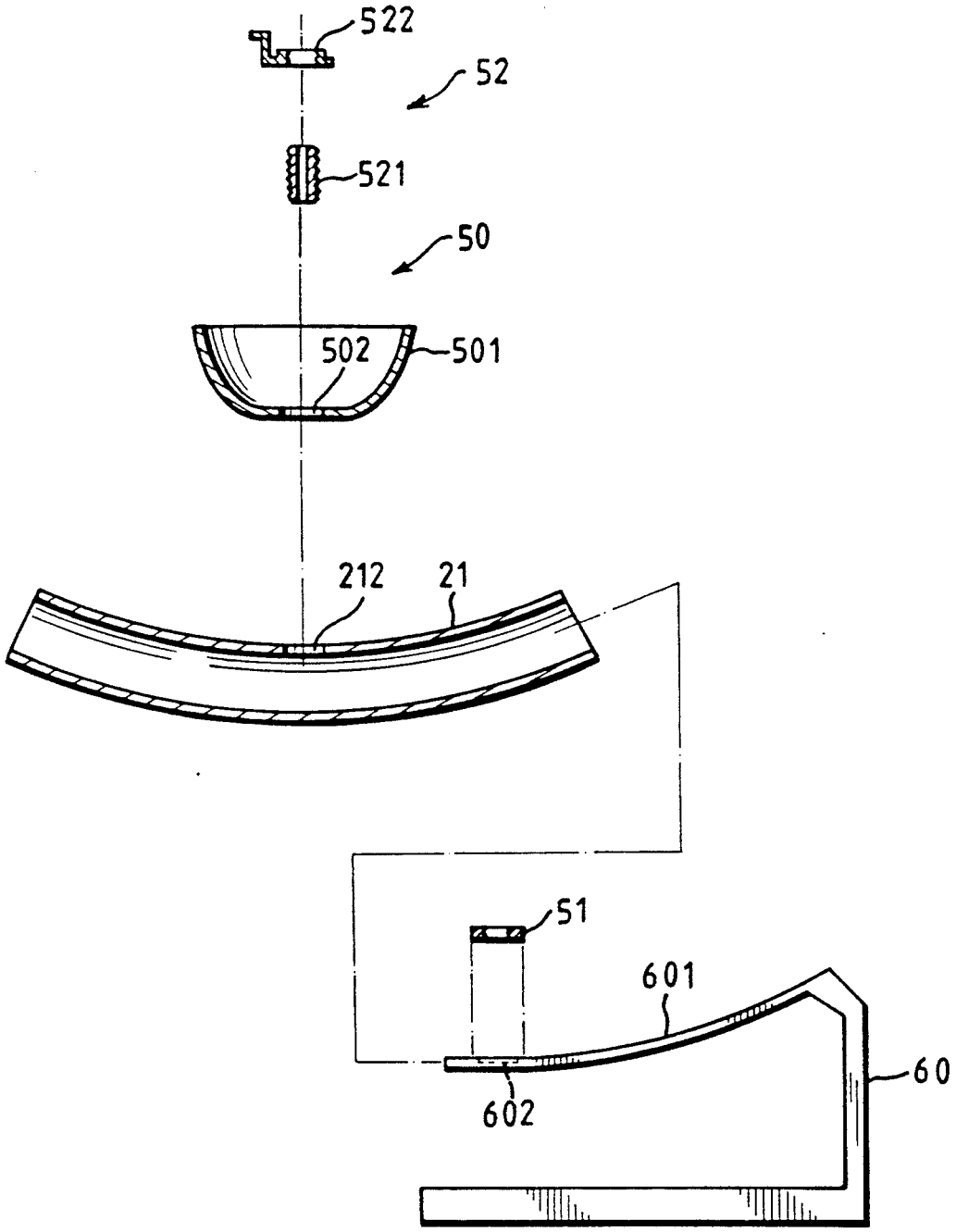

As illustrated in FIGS. 4 and 5, the illumination unit 50 is mounted on the fixture section 21 by means of a tool 60 in a known manner. The tool 60 has an elongated insertion portion 601 with a hexagonal hole 602 formed in the upper surface of the insertion portion 601. In assembly, the nut 51 is placed in the hole 602 of the tool 60. The insertion portion 601 of the tool 60 is inserted into the fixture section 21 until the hole 602 of the tool 60 is aligned with the opening 212 of the fixture section 21. Subsequently, the bolt unit 52 is passed through the shield 501 and the opening 212 to engage the nut 51. Because the bolt unit 52 is tubular, the electrical cord unit 53 can extend through the opening 212 and the bolt unit 52 to couple with the light-generating member 54. As illustrated, the fixture sections 21 are sufficiently short in length to permit the illumination unit 50 to couple with two electrical cord elements, one being indicated by the solid lines, the other by the phantom lines in FIG. 6.

Figure 7:
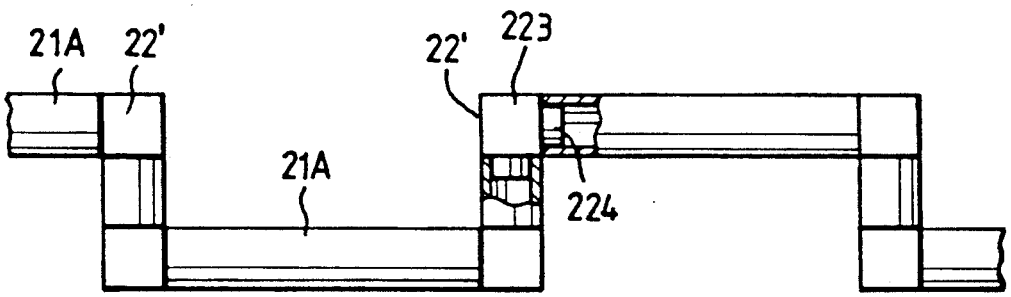
FIG. 7 illustrates a modular angular/curvature light fixture assembly according to a second embodiment of this invention.
Figure 8:
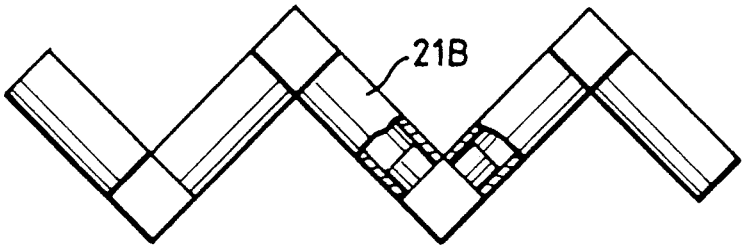
FIG. 8 illustrates a modular angular/curvature light fixture assembly according to a third embodiment of this invention.

The coupling units 22 may be modified in order to interconnect straight fixture sections. Referring to FIG. 7, several straight fixture sections 21A are interconnected by six generally L-shaped coupling units 22' each of which has an intermediate section 223 and two connector sections 224 which extend from the intermediate section 223 and which forms an angle of 90 degrees therebetween. The coupling units 22' are made of metal and are press fitted in the end portions of the straight fixture sections 21A. Referring to FIG. 8, the straight fixture sections 21B may be arranged so as to form a saw-tooth shaped light assembly.

Figure 9:
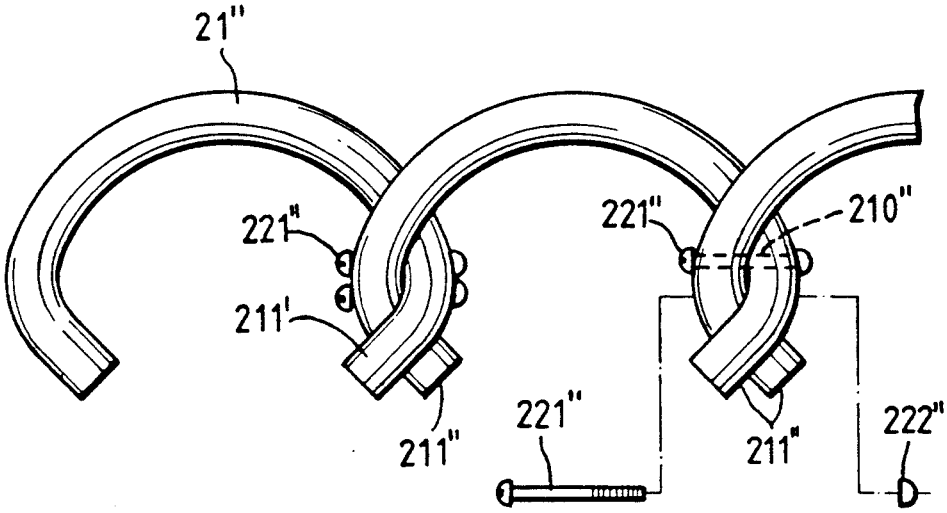
FIG. 9 illustrates a modular angular/curvature light fixture assembly according to a fourth embodiment of this invention.

FIG. 9 illustrates another embodiment in which three C-shaped tubular fixture sections 21'' are interconnected by several coupling units 22''. Each of the fixture sections 21'' includes two end portions each of which has two parallel pairs of aligned fastener holes 210'' formed therethrough. Each of the coupling units 22'' consists of a bolt 221'' extending through two aligned pairs of the aligned fastener holes 210'' of an adjacent pair of the tubular fixture sections 21'', and a nut 222'' engaged threadably with the bolt 221'' so as to removably interconnect the adjacent pair of the tubular fixture sections 21''.

With this invention thus explained, it is apparent that numerous modifications and variations can be made without departing from the scope and spirit of this invention. It is therefore intended that this invention be limited only as indicated in the appended claims.

I claim:

1. A modular angular/curvature light fixture assembly comprising a plurality of tubular fixture sections each of which has an opening formed through a wall thereof, a plurality of coupling units interconnecting said tubular fixture sections in such a manner that any adjacent pair of said tubular fixture sections are coupled together by one of said coupling units, an electrical cord unit extending through said tubular fixture sections and adapted to be connected to an electric power supply, and a plurality of illumination units mounted removably on some of said tubular fixture sections and electrically connected to said electrical cord unit in such a manner that said electrical cord unit extends through corresponding ones of said openings, each of said illumination units including a bowl-like shield with a central hole formed through a central portion thereof, a tubular bolt having an externally threaded stem extending through said central hole of said shield and one of said openings, and a nut engaged threadably with said stem of said bolt and positioned in one of said tubular fixture sections so as to retain said illumination unit on said tubular fixture section.

2. A modular angular/curvature light fixture assembly comprising a plurality of tubular fixture sections each of which has an opening formed through a wall thereof, a plurality of coupling units interconnecting said tubular fixture sections in such a manner that any adjacent pair of said tubular fixture sections are coupled together by one of said coupling units, an electrical cord unit extending through said tubular fixture sections and adapted to be connected to an electric power supply, and a plurality of illumination units mounted removably on some of said tubular fixture sections and electrically connected to said electrical cord unit in such a manner that said electrical cord unit extends through corresponding ones of said openings, wherein each of said coupling units is an elongated metal connector which consists of a large-diameter middle portion and two small-diameter end portions integrally formed with two ends of said large-diameter middle portion and having a diameter smaller than that of said large-diameter middle portion, each of said small-diameter end portions of said connectors being press fitted in an end portion of one of said tubular fixture sections.

3. A modular angular/curvature light fixture assembly as claimed in claim 2, wherein each of said coupling units is generally L-shaped and includes an intermediate section and two connector sections which extend from said intermediate section and which forms an angle of 90 degrees therebetween, said coupling units being made of metal, each of said connector sections being press fitted in an end portion of one of said tubular fixture sections.

4. A modular angular/curvature light fixture assembly as claimed in claim 2, wherein each adjacent pair of said tubular fixture units are interconnected removably.

5. A modular angular/curvature light fixture assembly as claimed in claim 4, wherein each of said tubular fixture units are C-shaped and has two end portions each of which has two aligned fastener holes formed therethrough, each of said coupling units including a bolt extending through two aligned pairs of said aligned fastener holes of an adjacent pair of said tubular fixture sections, and a nut engaged threadably with said bolt so as to join said adjacent pair of said tubular fixture sections together.

* * * * *